US005381627A

United States Patent [19]

Simon et al.

[11] Patent Number: 5,381,627

[45] Date of Patent: Jan. 17, 1995

[54] PANIC GUARD

[75] Inventors: Martin S. Simon; Ira J. Simon, both of Long Beach, Calif.

[73] Assignee: Triangle Brass Manufacturing Company, Los Angeles, Calif.

[21] Appl. No.: 59,408

[22] Filed: May 10, 1993

[51] Int. Cl.[6] ..... E06B 7/00

[52] U.S. Cl. ..... 49/70; 70/92

[58] Field of Search ..... 49/70, 460; 292/21, 292/92, 346, DIG. 2, DIG. 15; D8/343, 346, 300, 331, 400, 402; 70/92, 91; 16/1 R, DIG. 2

[56] References Cited

U.S. PATENT DOCUMENTS

| | | | |
|---|---|---|---|
| D. 322,745 | 12/1991 | Olsen | D8/346 |
| D. 332,908 | 2/1993 | Olson | D8/346 |
| 1,094,677 | 4/1914 | Page | 292/21 |
| 2,752,773 | 7/1956 | Abelson et al. | 70/92 |
| 2,899,718 | 8/1959 | Engels | 49/460 |
| 3,097,007 | 7/1963 | Eichacker et al. | 292/92 |
| 3,765,198 | 10/1973 | Horgan, Jr. | 70/92 |
| 3,819,213 | 6/1974 | Vanderburgh | 292/21 |
| 4,194,658 | 3/1980 | Tschudin | 225/65 |
| 4,736,974 | 4/1988 | Rosenthal | 292/343 |
| 4,928,430 | 5/1990 | George | 49/70 X |

FOREIGN PATENT DOCUMENTS

| | | | |
|---|---|---|---|
| 2913596 | 2/1980 | Germany | 49/460 |

OTHER PUBLICATIONS

"Handy Kap", *The Panic Bolt Guard,* 2 page brochure.

*Primary Examiner*—Flemming Saether
*Assistant Examiner*—Jerry Redman
*Attorney, Agent, or Firm*—D'Alessandro, Frazzini & Ritchie

[57] ABSTRACT

A curved panic guard for use with external vertical rod exit devices has no sharp, angled or flat projecting surfaces to interfere with the passage of a wheelchair.

14 Claims, 10 Drawing Sheets

PANIC GUARD

BACKGROUND OF THE INVENTION

1. Field of the Invention

This invention relates to the field of guards and covers for covering exposed vertical rod exit devices which are incorporated in horizontal bar operated panic latches.

2. Description of Related Art

Wheelchair bound individuals frequently have difficulty getting through doors equipped with exposed vertical rod exit devices. Such exit devices are commonly required to be used in public buildings and generally incorporate a horizontal bar or "crash bar" which, when pushed, releases latches engaged with a vertical bar and allows the door to open. Virtually all public buildings are equipped with "panic latches" of this general type. A drawback of panic latches is that the exposed vertical bar and related hardware can interfere with wheelchairs resulting in damage to the wheelchair, damage to the door, and difficulty to the wheelchair bound individual in getting through the door.

Prior art panic guards, while fit for their intended purpose, provide angled, sharp surfaces which may interfere with the passage of a wheelchair.

SUMMARY OF THE INVENTION

The present invention is directed to an improved panic guard which employs continuously curved external surfaces at all points that it projects from the bottom of the door to minimize interaction with wheelchairs. The present invention is adapted to be retrofit to existing panic latch equipped doors without removal or disassembly of the door.

Other and further objects and advantages of the present invention will appear hereinafter.

DESCRIPTION OF THE PREFERRED EMBODIMENT

Figure 1:
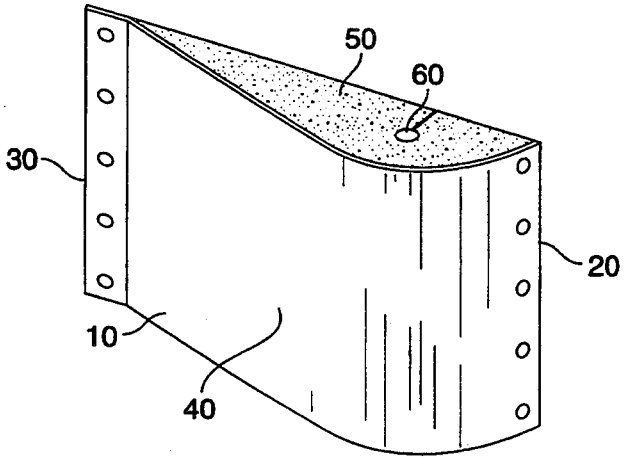
FIG. 1 is a front perspective view of a first preferred embodiment of the present invention showing the top and front of the panic guard.
Figure 2:
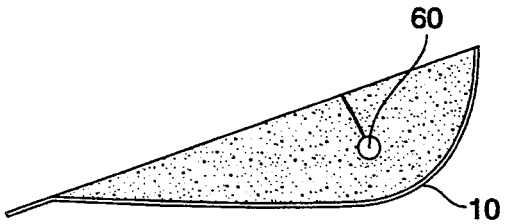
FIG. 2 a top view of a first preferred embodiment of the pigment invention.
Figure 3:
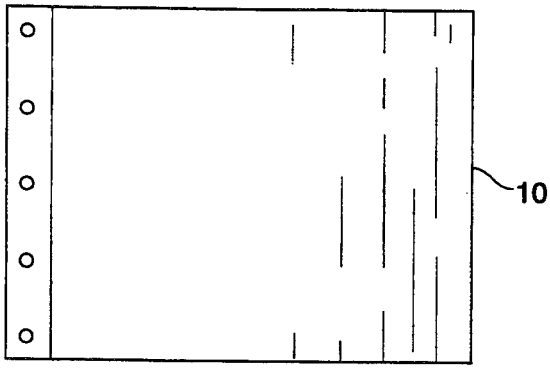
FIG. 3 is a front elevational view of a first preferred embodiment of the present invention.
Figure 4:
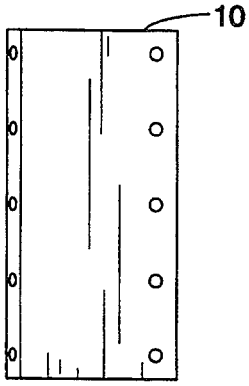
FIG. 4 is a side elevational view of a first preferred embodiment of the present invention.
Figure 5:
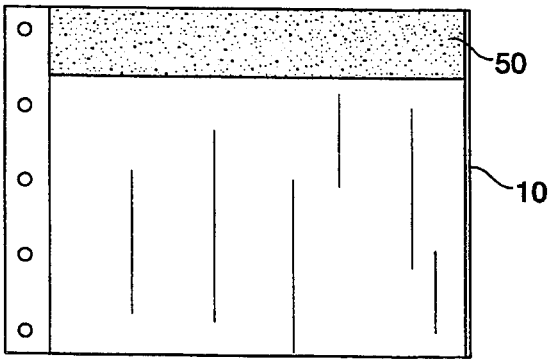
FIG. 5 is a rear elevational view of a first preferred embodiment of the present invention.
Figure 6:
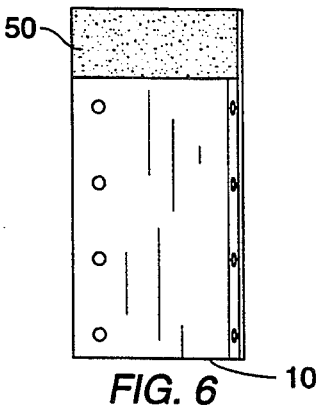
FIG. 6 is a side elevational view of a first preferred embodiment of the present invention showing the interior of the panic guard.
Figure 7:
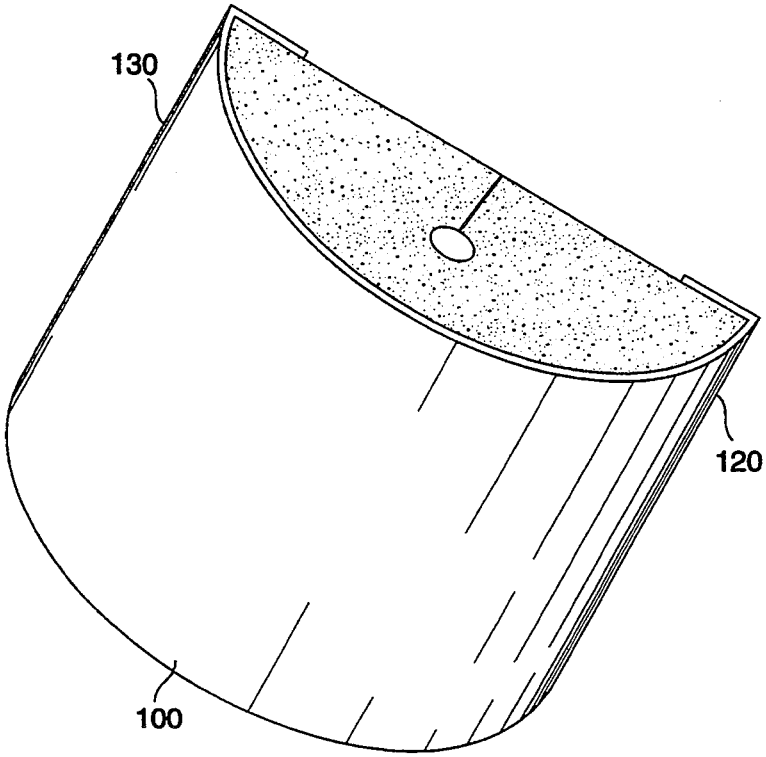
FIG. 7 is a front perspective view of a second preferred embodiment of the present invention showing the top and front of the panic guard.
Figure 8:
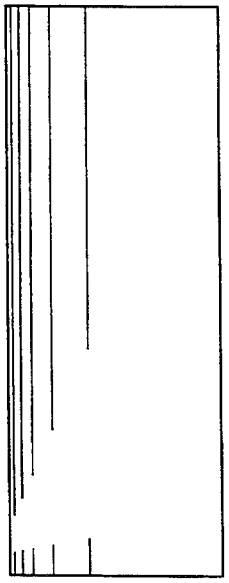
FIG. 8 is a side elevational view of a second preferred embodiment of the present invention.
Figure 9:
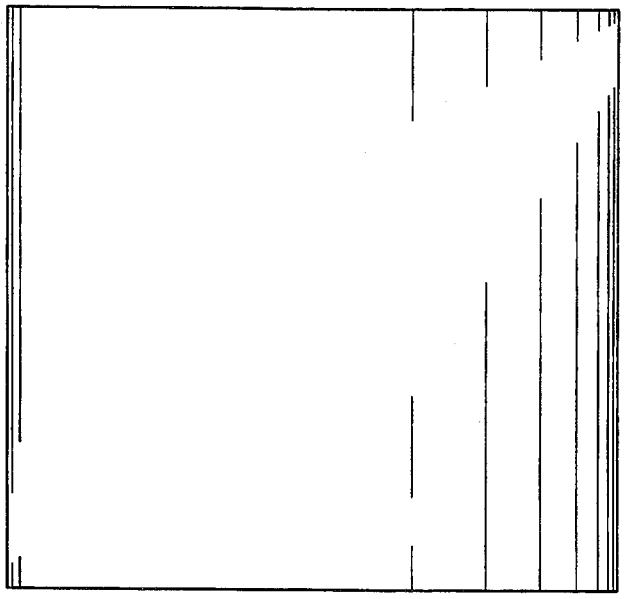
FIG. 9 is a front elevational view of a second preferred embodiment of the present invention.
Figure 10:
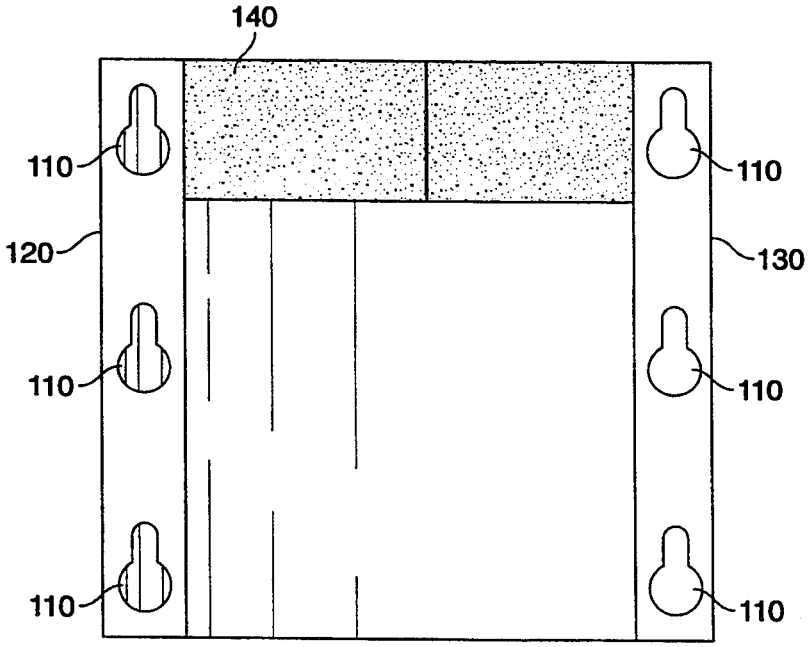
FIG. 10 is a rear elevational view of a second preferred embodiment of the present invention showing the interior of the panic guard.
Figure 11:
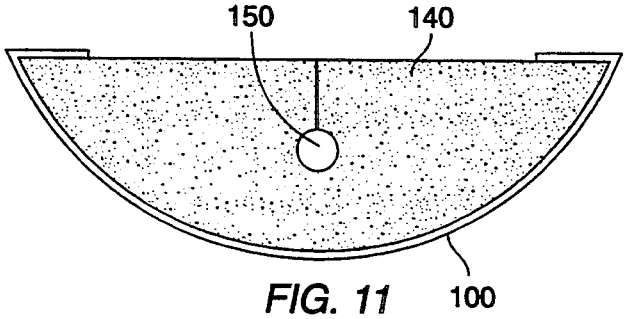
FIG. 11 is a top view of a second preferred embodiment of the present invention.
Figure 12:
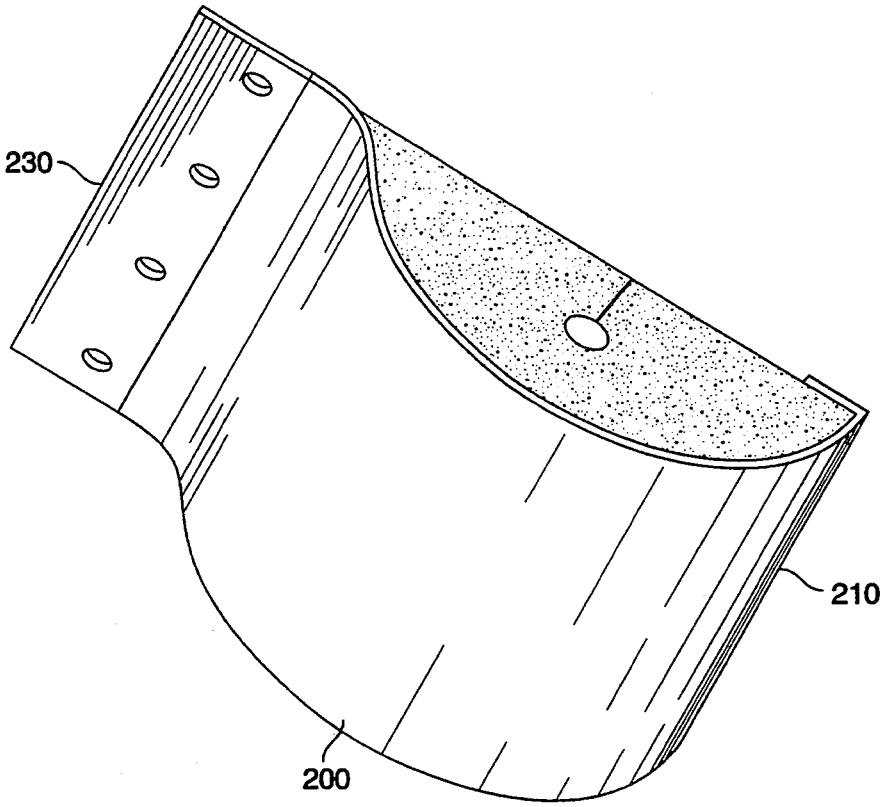
FIG. 12 is a front perspective view of a third preferred embodiment of the present invention showing the top and front of the panic guard.
Figure 13:
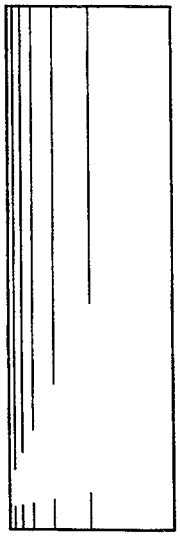
FIG. 13 is a side elevational view of a third preferred embodiment of the present invention.
Figure 14:
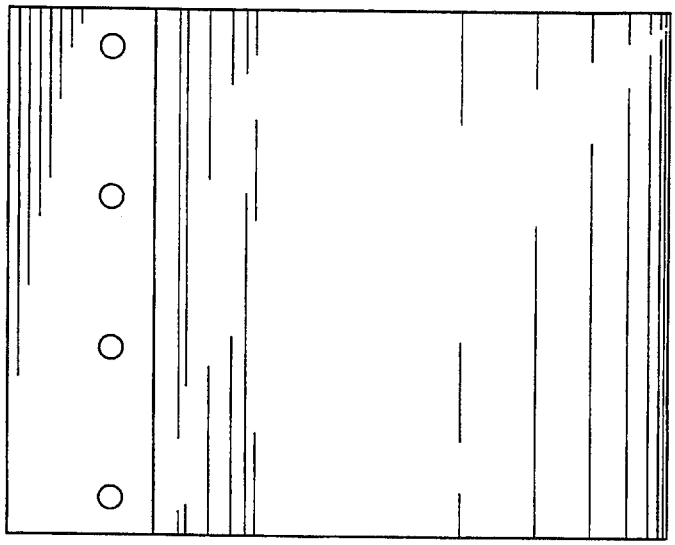
FIG. 14 is a front elevational view of a third preferred embodiment of the present invention.
Figure 15:
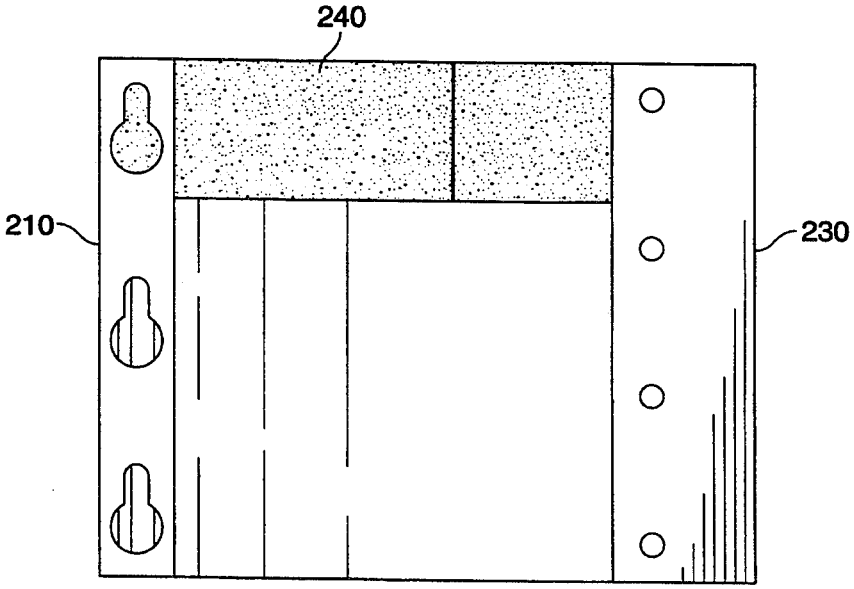
FIG. 15 is a rear elevational view of a third preferred embodiment of the present invention showing the interior of the panic guard.
Figure 16:
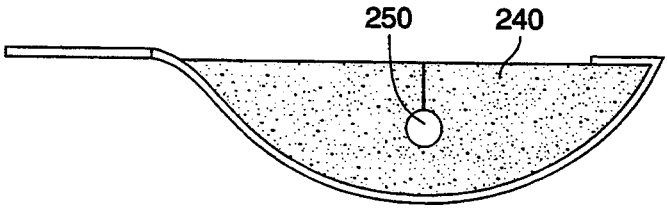
FIG. 16 is a top view of a third preferred embodiment of the present invention.
Figure 17:
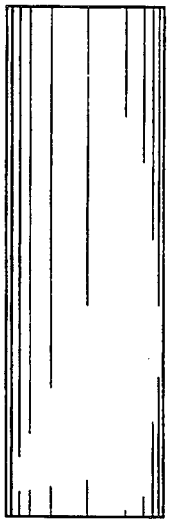
FIG. 17 is a side elevational view of a third preferred embodiment of the present invention showing the interior of the panic guard.

Wheelchair bound individuals have experienced difficulties in getting in and out of doors equipped with vertical rod exit devices. Shrouds or guards for these devices must cover the exposed mechanism from the floor to about 10 inches up the door 5. The guard should not further impede the passage of wheelchairs. Turning to the drawings, FIG. 1 illustrates a first embodiment of the present invention. The guard 10 is adapted to be mounted to the bottom of a vertical rod exit device equipped door. The first preferred embodiment (FIGS. 1, 2, 3, 4, 5, 6, 20, 21A, 21B, 21C) is not handed, i.e., the same unit may be used on a door with its hinges on the left or right. (None of the preferred embodiments are "handed".) It is preferably mounted with fasteners such as countersunk screws or nails to the surface of a door. As shown in FIG. 1, side 20 is adapted to be mounted flush with the free edge of a swinging door, while side 30 is adapted to be mounted flush with the front surface of the swinging door and is in the shape of a continuously curved plane. All portions of the front surface 40 of the panic guard which project from the door are smooth and curved so as to minimize the likelihood that they will interact in any way with a wheelchair. The top 50 of the panic guard is preferably a piece of foam rubber cut to fit between the door and the projecting surface of the panic guard. A hole 60 is preferably provided in the foam rubber insert 50 to permit the vertical rod 330 of the vertical rod exit device to pass through. The panic guard is preferably fabricated from a piece of sheet metal. Aluminum, steel, other metals or tough plastics may be used and various surface treatments may be employed to provide appropriate aesthetics.

Turning to FIGS. 7, 8, 9, 10, 11 and 18, a second embodiment of the present invention is illustrated. In the second embodiment, a constant curve is provided in front surface 100 and the panic guard is adapted to be attached to pre-mounted fasteners such as screws or nails on which keyholes 110 may attach the panic guard to the door. Edge 120 or 130 is preferably mounted so that it is flush with the free edge of the door. Again, a foam rubber insert 140 is provided with a hole 150 therethrough for the vertical rod to pass.

Turning to FIGS. 12, 13, 14, 15, 16, 17 and 19, a third embodiment of the present invention is illustrated. In the third preferred embodiment, an "S"-shaped curve is provided in the front surface 200. The panic guard is adapted to be mounted at side 210 with keyhole type fasteners and at side 230 with more conventional nails or screws. As with the other embodiments, a foam rubber insert 240 is provided to fit between the door and the panic guard and a hole 250 is provided for the vertical rod to fit through.

Preferably a slit (shown in FIG. 2 only) may be cut in the foam rubber inserts 50, 140, 240 between the hole 60, 150, 250 and the outer periphery of the foam insert so that the foam insert may be fit over the vertical rod without the need to disassemble the door latch mechanism in any way.

Figure 18:
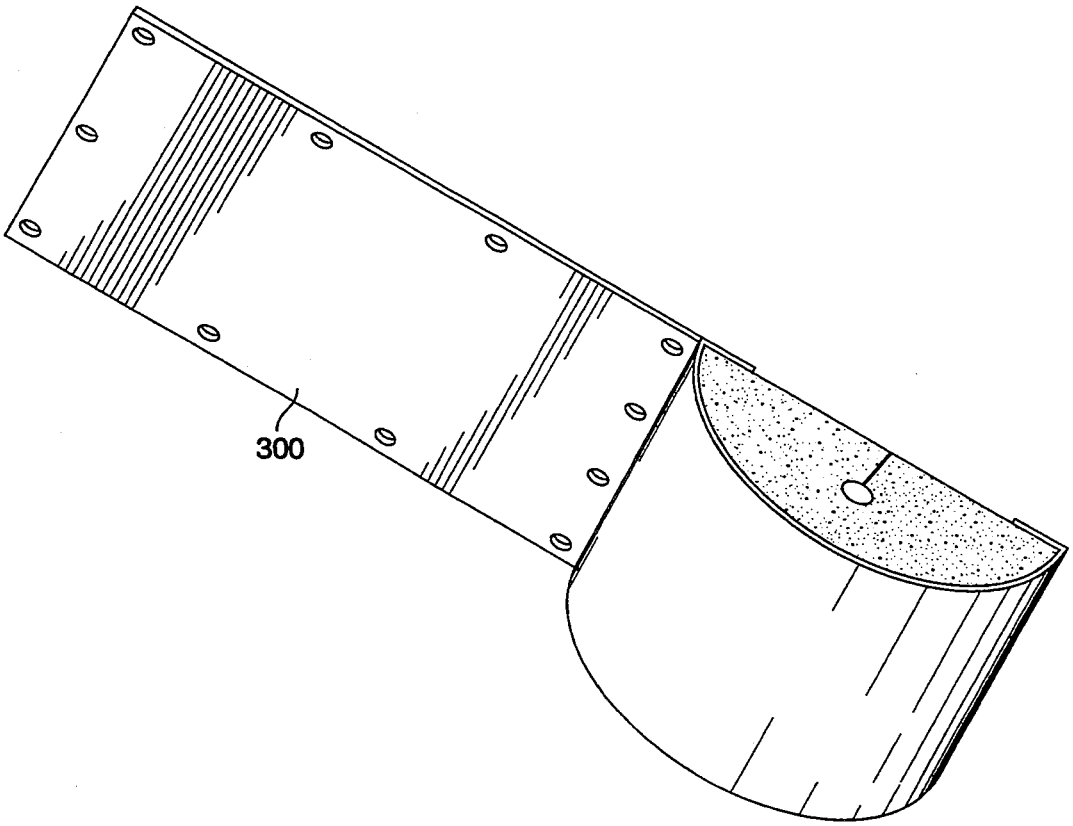
FIG. 18 is a front perspective view of a modification of a second preferred embodiment of the present invention.
Figure 19:
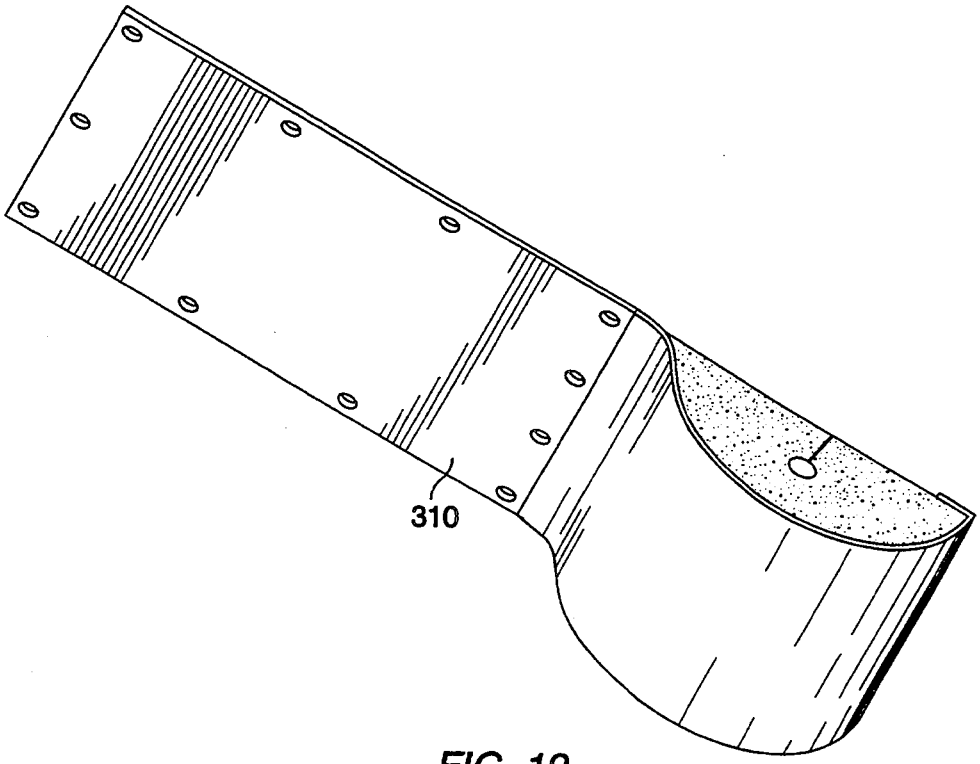
FIG. 19 is a front perspective view of a modification of a third preferred embodiment of the present invention.
Figure 20:
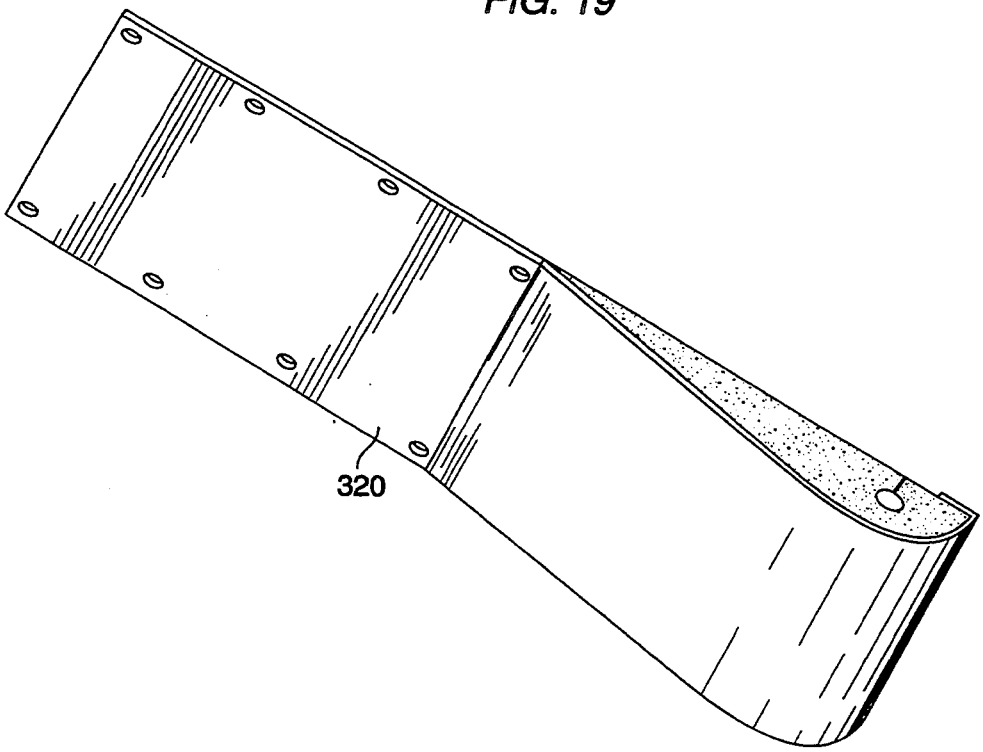
FIG. 20 is a front perspective view of a modification of a first preferred embodiment of the present invention.
Figure 21A:
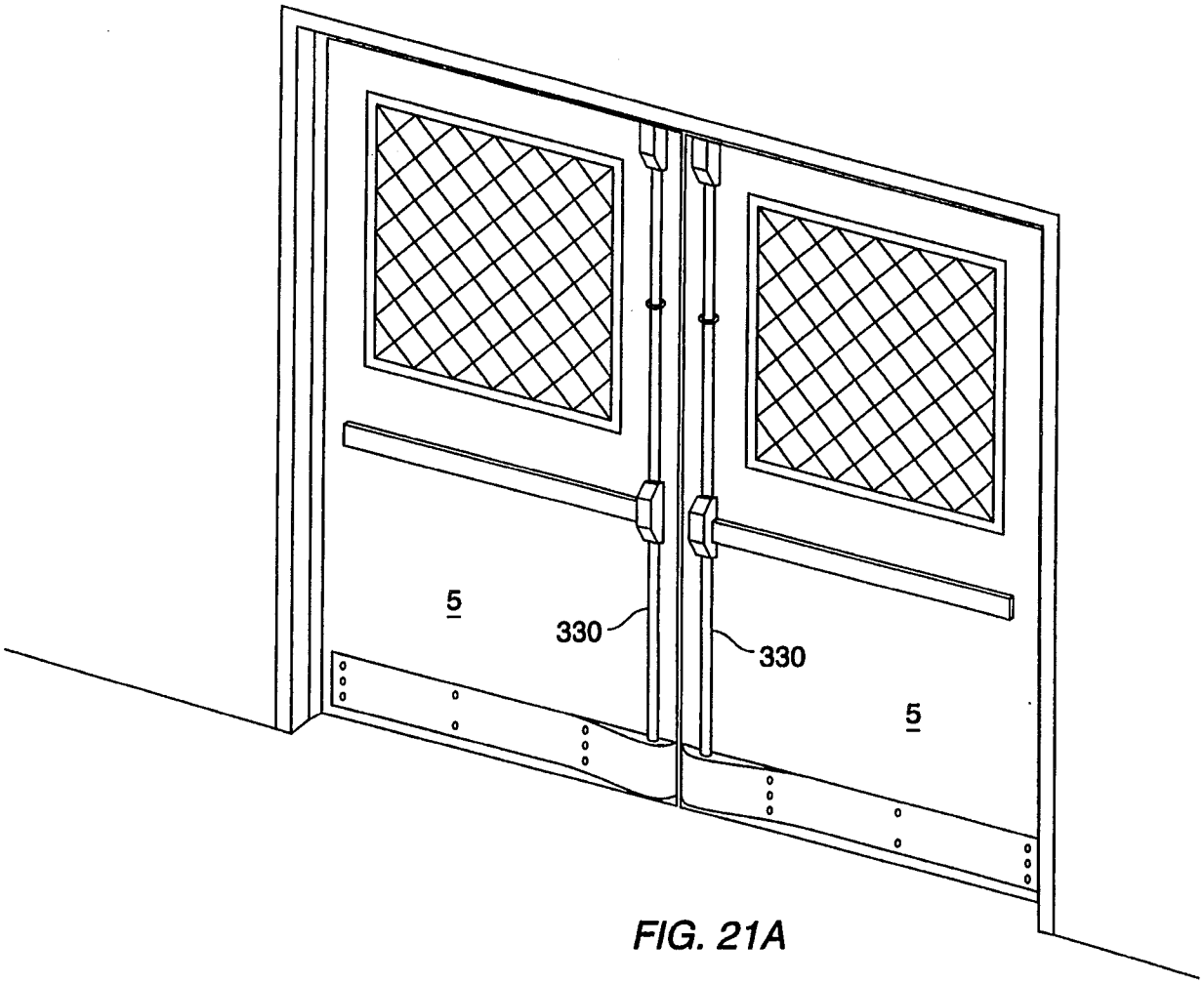
FIG. 21A is a front perspective view of a double door equipped with crash bars, vertical rods, and a modification of a first preferred embodiment of the present invention.
Figure 21B:
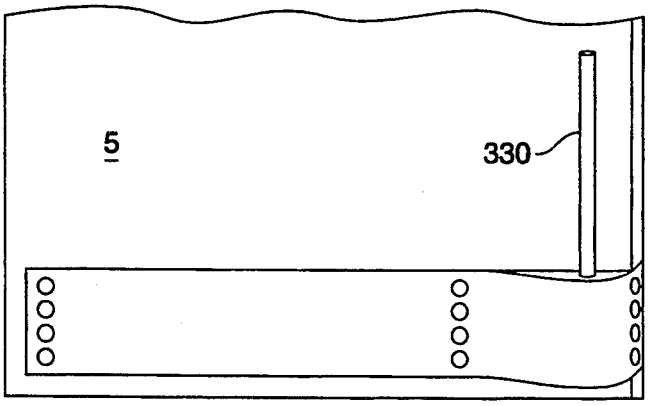
FIGS. 21B and 21C are front perspective views of a door equipped with a vertical rod and a first preferred embodiment of the present invention.
Figure 21C:
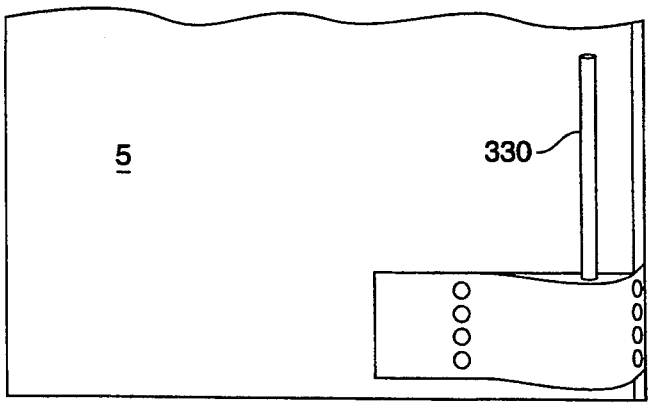

Turning to FIGS. 18, 19 and 20, these drawings illustrate modifications of the three embodiments to include a kickplate (300, 310, 320) which may be attached to the door to provide additional strength and protect it from scratches. The kickplates are adapted to be attached to the door with conventional means such as screws, nails, or adhesives.

While embodiments and applications of this invention have been shown and described, it would be apparent to those of to skill in the art that many more modifications are possible without departing from the inventive concepts herein. The invention, therefore, is not to be restricted except in the spirit of the appended claims.

What is claimed is:

1. A panic guard for a door having a front surface and a free edge and equipped with an external vertical rod exit device including an external vertical rod, said panic guard comprising:

a continuously curved projecting surface having a pair of mounting flanges for mounting the panic guard to the door, a foam rubber insert having a top and a bottom, said insert adapted to fit between said curved protecting surface and the front surface of the door, said insert including an orifice connecting said top with said bottom and a slit connecting said orifice with a side wall of said insert, said orifice adapted to receive the external vertical rod and said slit adapted to provide a means for installing the external vertical rod in said orifice.

2. A panic guard for a door having a front surface and equipped with an external vertical rod exit device comprising:

a continuously curved plate adapted to be mounted to the door;

an insert adapted to fit between said guard plate and the front surface of the door;

a hole penetrating said insert; and a slit connecting said hole with an outer periphery of said insert.

3. A panic guard for a door having a front surface and a free edge and equipped with an external vertical rod exit device comprising:

a continuously curved guard plate having a first mounting flange adapted to be mounted to the door and a second mounting flange adapted to be mounted to the door;

a flexible insert adapted to fit between said guard plate and the front surface of the door;

a hole penetrating said insert; and a slit connecting said hole with an outer periphery of said insert.

4. A panic guard for a door having a front surface and equipped with an external vertical rod exit device including an external vertical rod, said panic guard comprising:

a first and a second mounting flange adapted to be mounted to the front surface of the door;

a curved planar surface connecting said first and said second mounting flange; and a foam rubber insert having a top and a bottom, said insert adapted to fit between said curved planar surface and the front surface of the door, said insert including an orifice connecting said top with said bottom add a slit connecting said orifice with an outer periphery of said insert, said orifice adapted to receive the external vertical rod and said slit adapted to provide a means for installing the external vertical rod in said orifice.

5. The apparatus of claim 4 wherein said first and said second mounting flanges each include a plurality of keyhole shaped apertures therethrough.

6. A panic guard for a door having a front surface and a free edge and which is equipped with an external vertical rod exit device including an external vertical rod on the front surface of the door, said panic guard comprising:

a first mounting flange;

a second mounting flange;

a continuously curved planar surface connecting said first mounting flange and said second mounting flange; and a foam rubber insert having a top and a bottom, said insert adapted to fit between said curved planar surface and the front surface of the door, said insert including an orifice connecting said top with said bottom and a slit connecting said orifice with a side wall of said insert, said orifice adapted to receive the external vertical rod and said slit adapted to provide a means for installing the external vertical rod in said orifice.

7. The apparatus of claim 6 wherein said continuously curved planar surface is constantly curved.

8. The apparatus of claim 6 wherein said continuously curved planar surface comprises an S-shaped curve.

9. The apparatus of claim 6 wherein said first mounting flange is mounted to the free edge.

10. The apparatus of claim 6 wherein said first mounting flange is attached to the free edge and said second mounting flange is attached to the front surface.

11. The apparatus of claim 6 wherein said first and said second mounting flanges are both attached to the front surface.

12. A panic guard for a door having a front surface and a free edge and which is equipped with an external vertical rod exit device including an external vertical rod on the front surface of the door, said panic guard comprising:

a first edge;

a second edge;

a planar surface connecting said first edge and said second edge;

means for attaching said first edge to the door;

means for attaching said second edge to the door;

said planar surface curved and smooth at all points between said first edge and said second edge; and a foam rubber insert having a top and a bottom, said insert adapted to fit between said planar surface and the front surface of the door, said insert including an orifice connecting said top with said bottom and a slit connecting said orifice with a side wall of said insert, said orifice adapted to receive the external vertical rod and said slit adapted to provide a means for installing the external vertical rod in said orifice.

13. In a panic guard for a door having a front surface and a free edge and equipped with an external vertical rod exit device, the panic guard including a continuously curved guard plate having a first mounting flange adapted to be mounted to the door and a second mounting flange adapted to be mounted to the door, the improvement comprising:

a flexible insert adapted to fit between said guard plate and the front surface of the door;

a hole penetrating said insert; and a slit connecting said hole with an outer periphery of said insert.

14. In a panic guard for a door having a front surface equipped with an external vertical rod exit device, the panic guard including a continuously curved guard plate adapted to be mounted to the door, the improvement comprising:

a flexible insert adapted to fit between said guard plate and the front surface of the door;

a hole penetrating said flexible insert; and a slit connecting said hole with an outer periphery of said flexible insert.

* * * * *

UNITED STATES PATENT AND TRADEMARK OFFICE

CERTIFICATE OF CORRECTION

PATENT NO. : 5,381,627

DATED : January 17, 1995

INVENTOR(S) : Martin S. Simmon, and Ira J. Simon

It is certified that error appears in the above-indentified patent and that said Letters Patent is hereby corrected as shown below:

On Col. 1, line 46, replace "pigment" with —present—.
On Col. 3, line 57, after "curved" insert —guard—.
On Col. 4, line 19, replace "add" with —and—.

Signed and Sealed this

Twenty-ninth Day of August, 1995

*Attest:*

Bruce Lehman

BRUCE LEHMAN

*Attesting Officer*

*Commissioner of Patents and Trademarks*